US007110690B2

(12) United States Patent
Matsumoto

(10) Patent No.: US 7,110,690 B2
(45) Date of Patent: Sep. 19, 2006

(54) IMAGE FORMING APPARATUS AND METHOD OF CONTROLLING A HEATING UNIT

(75) Inventor: Hirotaka Matsumoto, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 140 days.

(21) Appl. No.: 10/787,377

(22) Filed: Feb. 27, 2004

(65) Prior Publication Data

US 2005/0191074 A1 Sep. 1, 2005

(51) Int. Cl.
*G03G 15/20* (2006.01)

(52) U.S. Cl. ..... 399/69; 399/33; 399/122; 399/330; 399/335

(58) Field of Classification Search ..... 399/69
See application file for complete search history.

(56) References Cited

U.S. PATENT DOCUMENTS 5,512,993 A * 4/1996 Endo et al. ..... 399/335
2002/0003970 A1* 1/2002 Goto et al. ..... 399/69
2003/0215255 A1* 11/2003 Kinouchi et al. ..... 399/69
2004/0086292 A1* 5/2004 Kamimura ..... 399/69
2004/0165904 A1* 8/2004 Tanaka ..... 399/69

FOREIGN PATENT DOCUMENTS

JP 8-166742 A 6/1996
JP 10-186939 A 7/1998

* cited by examiner

*Primary Examiner*—Arthur T. Grimley
*Assistant Examiner*—Ryan D. Walsh
(74) *Attorney, Agent, or Firm*—Foley & Lardner LLP

(57) ABSTRACT

An image forming apparatus according to an embodiment of the present invention can suppress overshoot by shifting the OFF timing of the central heater lamp from that of the end heater lamp or the recovering timing of the central heater lamp from that of the end heater lamp, when the heating member at a second temperature dropped from a first temperature (optimum fixing temperature) is returned to the first temperature again.

16 Claims, 8 Drawing Sheets

| Type | Drop control mode | Number of copies | Lamp OFF control | Priority | Priority lamp Off timing | Posterior lamp OFF timing |
|---|---|---|---|---|---|---|
| A | × | 5 copies or less | × | – | – | – |
| B | × | 6 copies or more | ○ | Central lamp | 0 seconds after the last sheet passes | When copy is stopped |
| C | First drop control | 6 copies or more | ○ | End lamp | 2 seconds before the last sheet passes | 0 seconds after the last sheet passes |
| D | Second drop control | 6 copies or more | × | – | – | – |

FIG. 7

| Type | Drop control mode | Number of copies | Recovery | Control (recovery) timing | Priority |
|---|---|---|---|---|---|
| A | × | 5 copies or less | Normal control | 0 seconds (immediately) after the end | × |
| B | × | 6 copies or more | Normal control | 2 seconds after the end | × |
| C | First drop control | 6 copies or more | Normal control | 30 seconds after the stop | End lamp |
| D | Second drop control | 6 copies or more | First drop control | 60 seconds after the stop | End lamp |

FIG. 8

IMAGE FORMING APPARATUS AND METHOD OF CONTROLLING A HEATING UNIT

BACKGROUND OF THE INVENTION

1. Field of the Invention

This invention relates to an image forming apparatus which forms an image on a transfer material by an electrophotographic process.

2. Description of the Related Art

In a fuser incorporated in an image forming apparatus using an electrophotographic process, a thin heating roller is used as a heat roller fixing system.

In addition, control is used which lowers the heating preset temperature because the heating roller and pressure roller get warm sufficiently as a result of consecutive copying.

However, after the copying has been completed or the sheets of paper have passed, the heating roller and pressure roller are warmed sufficiently by remaining heat or the like. Thereafter, when the temperature of heating roller is returned to the heating present temperature before the temperature drop, an overshoot phenomenon takes place, which is a problem.

When a heating roller containing a thin electrically conductive sheet is used for induction heating, temperature changes are particularly large. In addition, when a heater lamp is used, the response is poor, which causes the following problems: damage to parts and the corruption of such images as high-temperature offset images in subsequent copying.

BRIEF SUMMARY OF THE INVENTION

According to an aspect of the present invention, there is provided an image forming apparatus comprising:

a heating member which includes a first region and a second region: the second region locates in a predetermined position in the axial direction with respect to the first region; a heating unit which is provided inside the heating member and which includes at least one of a first heating member for heating the first region and a second heating member for heating the second region; a main control unit which carries out at least a first control mode and a second control mode; the first control mode (temperature drop control mode) which performs control to drop the temperatures in the first and second regions from a fixing temperature by a predetermined temperature, with predetermined timing at least once, while an image formation is being executed at the fixing temperature; and the second control mode (lamp OFF control mode) which turns off the first heating member and the second heating member with predetermined timing corresponding to the temperature supplied in the first control mode, when the image formation is completed.

According to another aspect of the present invention, there is provided a method of controlling a heating unit, comprising: (1) when an image formation is executed at a first temperature, performing control to drop the temperature of a heating roller to a second temperature lower than the first temperature, with predetermined timing at least once; (2) when the image formation is completed, turning off the heating member with predetermined timing corresponding to the second temperature lowered from the first temperature; and (3) after the image formation is completed, returning from the second temperature to the first temperature.

According to further another aspect of the present invention, there is provided an image forming apparatus comprising: heating means for heating a heating member; dropping means for dropping the heating member kept at a first temperature to a second temperature lower than the first temperature with predetermined timing; OFF means for turning off the heating member according to the second temperature; and recovering means for returning the heating member kept at the second temperature to the first temperature with predetermined timing.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 7 is a reference diagram to help explain a heating method to which the embodiment of the invention can be applied;

FIG. 8 is a reference diagram to help explain another heating method to which the embodiment of the invention can be applied;

DETAILED DESCRIPTION OF THE INVENTION

Hereinafter, referring to the accompanying drawings, an image forming apparatus to which an embodiment of the present invention is applied will be explained.

Figure 1:
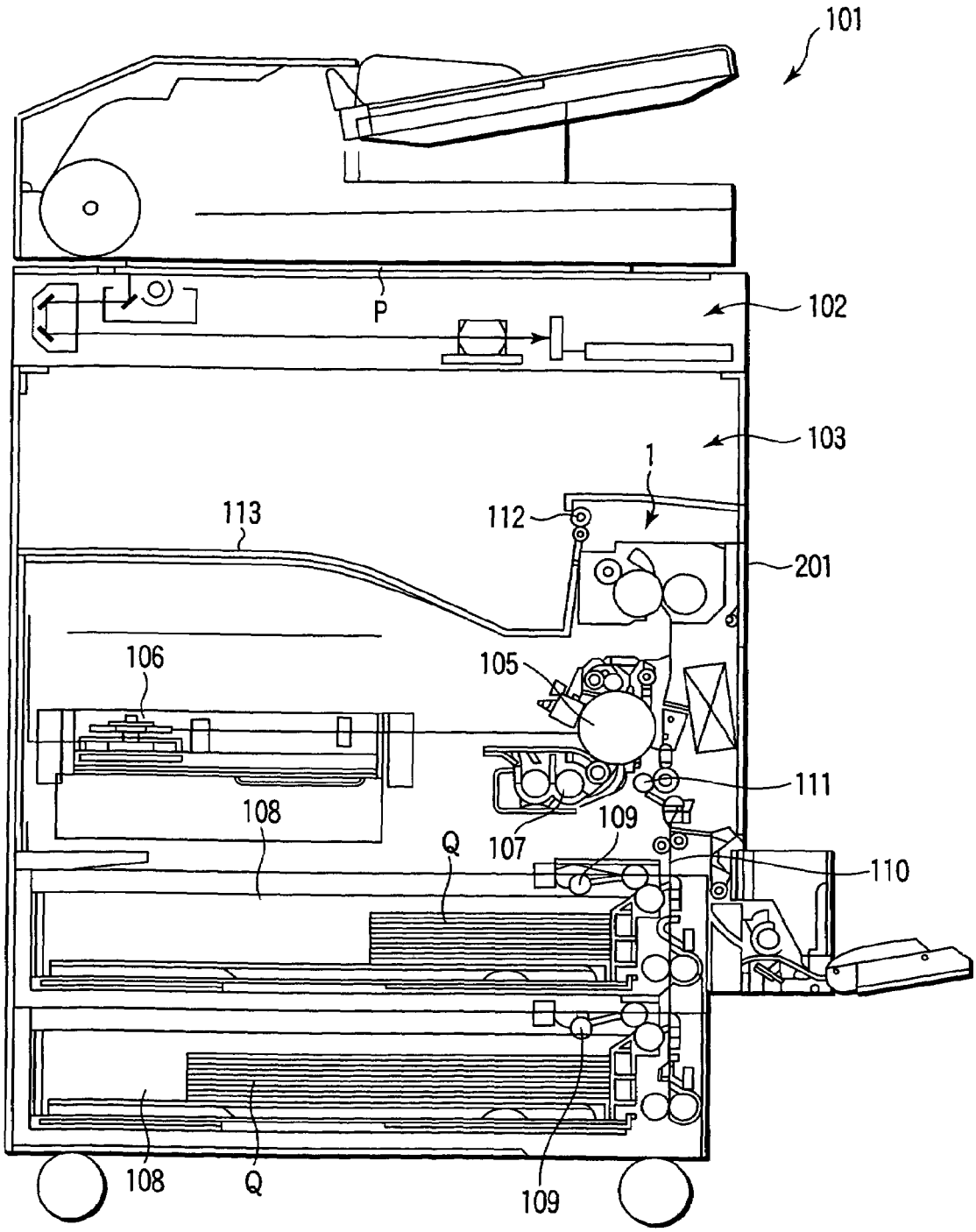
FIG. 1 is a schematic diagram to help explain an image forming apparatus to which an embodiment of the present invention can be applied.

As shown in FIG. 1, an image forming apparatus (digital copying machine) 101 comprises an image reading unit (scanner) 102 for reading the image of an object to be copied (document) P and generating an image signal and an image forming section 103 for forming an image on the basis of the image signal outputted from the scanner 102. The image forming section 103 includes a fuser 1, a photosensitive drum 105, an exposure unit 106, a developing unit 107, a sheet cassette 108, a pickup roller 109, a transport path 110, an aligning roller 111, a output roller 112, and a output tray 113.

The fuser 1 applies heat and pressure to a sheet Q retaining a developer image and fixes the melted developer image to the sheet Q.

Therefore, the sheet Q passes the photosensitive drum 105 and fuser 1 vertically in that order, with the result that the image of the document P is formed. The sheet Q on which the image has been formed is outputted by the output roller 112 into the output tray 113 defined between the sheet cassette 108 and the scanner 102.

Figure 2:
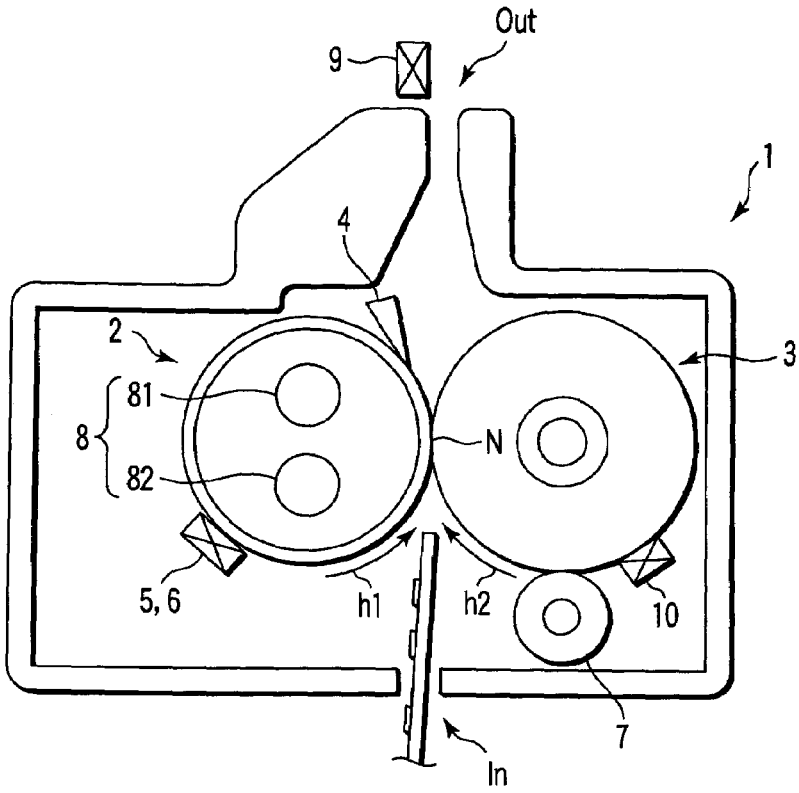
FIG. 2 is a schematic diagram to help explain a fuser installed in the image forming apparatus of FIG. 1.

FIG. 2 shows an example of the fuser installed in the image forming apparatus of FIG. 1. As shown in FIG. 2, the fuser 1 includes a heating roller 2, a pressure roller 3, a peeling claw 4, temperature sensing elements 5, 6, a cleaning member 7, a heating unit 8, a output sensor 9, and a pressure roller temperature sensing element 10.

The heating roller 2 is a cylindrical electric conductor made of aluminum, iron, or the like to a thickness of, for example, 0.8 mm. The surface of the heating roller may be coated with a resinous, peeling layer of a resin polymerized with tetrafluoroethylene, such as Teflon (a brand name).

The pressure roller 3 is an elastic roller with a predetermined diameter, and is covered with silicone rubber, fluoric rubber, or the like of a predetermined thickness.

The pressure roller 3 is pressed against the heating roller 2 at a predetermined pressure. Both of the rollers 2, 3 are kept almost in parallel with the axis line. Therefore, a contact part (nip) with a predetermined width (nip width) is formed between the two rollers 2, 3.

The heating roller 2 is rotated in the direction shown by arrow h1 by a motor M explained later by reference to FIG. 3, with the result that the pressure roller 3 is rotated (driven) in the direction shown by arrow h2.

The heating unit 8 can supply a predetermined amount of heat to the heating roller 2 from inside by a heater lamp system. Therefore, the toner on the sheet Q passing the nip part N is melted and fixed to the sheet Q.

The output sensor 9 is provided near the outlet of the fuser 1. When the sheet Q is at the outlet, the output sensor informs the CPU 22 of the presence of the sheet.

In the embodiment, each of the heating roller 2 and pressure roller 3 has a diameter of 30 mm.

Figure 3:
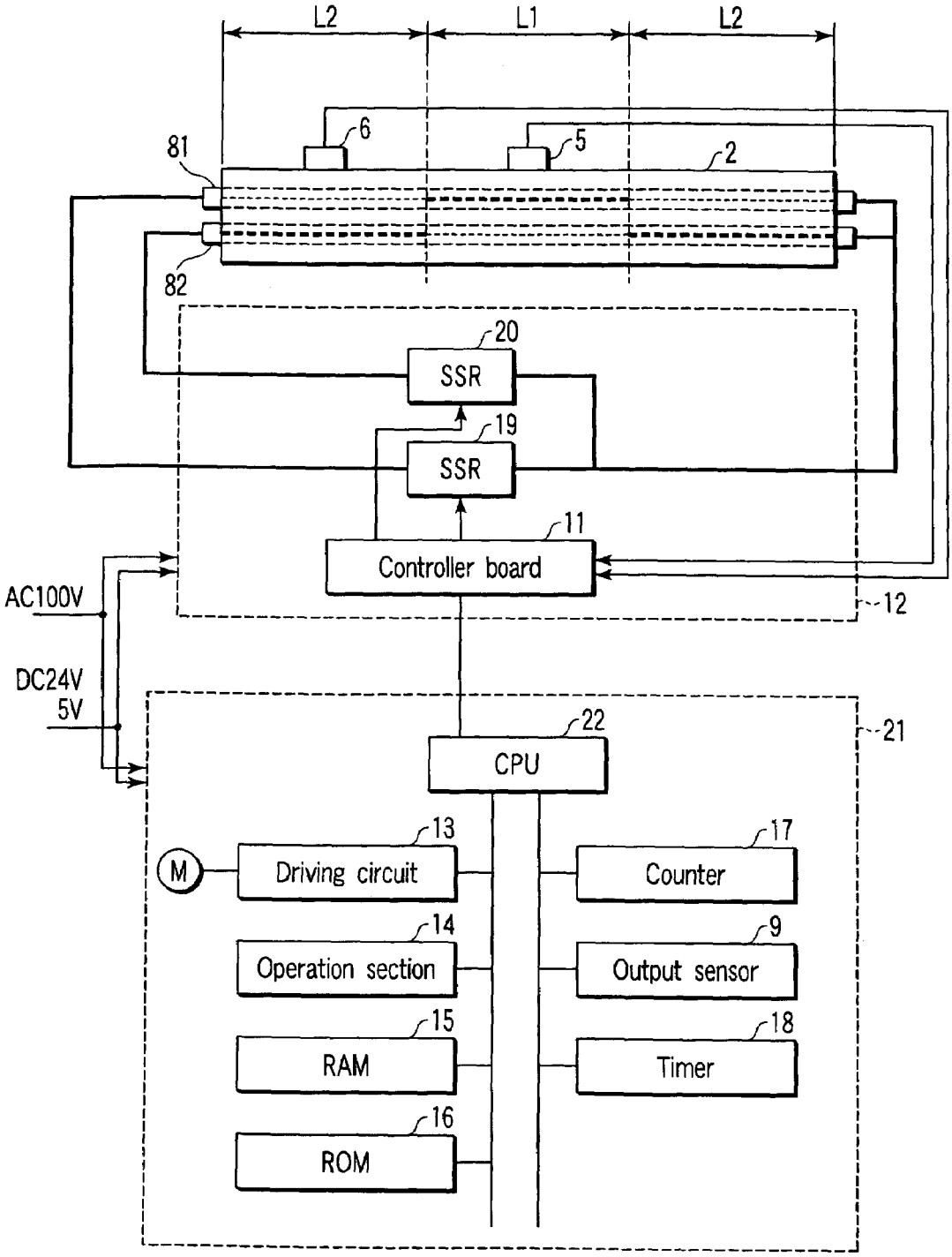
FIG. 3 is a schematic diagram to help explain the operation of the fuser of FIG. 2.

FIG. 3 shows an example of the heating unit provided in the fuser.

As shown in FIG. 3, the heating unit 8 is connected to the temperature control unit 12 including a controller board 11.

The heating unit 8 includes two halogen lamps: a central heater lamp 81 for heating the central part of the heating roller 2 and pressure roller 3 in the axial direction and an end heater lamp 82 for heating both ends of the central part in the axial direction.

The central heater lamp 81 has a heating region defined by length L1 in the axial direction.

The central heater lamp 81 is connected to the controller board 11 via an SSR 19. The end heater lamp 82 is connected to the controller board 11 via an SSR 20. The end heater lamp 82 has a heating region defined by length L2 in the axial direction.

A center temperature T1 of the central part of the heating roller 2 sensed by a thermistor 5 and an end temperature T2 of the end part of the heating roller 2 sensed by a thermistor 6 are inputted to the controller board 11. According to the temperatures T1, T2, the controller board 11 performs control so that the surface of the heating roller 2 may be at a uniform fixing temperature in the axial direction. In addition, according to the desired temperature level of the surface of the heating roller 2, the controller board 11 supplies predetermined electric power to the central heater lamp 81 and end heater lamp 82. The predetermined electric power may be supplied to the central heater lamp 81 and end heater lamp 82 alternately or at the same time.

The thermistor 5, which is provided outside and in the center of the heating roller 2 in the axial direction, senses the temperature in the region warmed by the central heater lamp 81. The thermistor 6, which is provided outside and at one end of the heating roller 2 in the axial direction, senses the temperature in the region warmed by the end heater lamp 82.

The lengths L1 and L2 are determined according to the size and material of the passing sheet Q so that the temperature difference in the axial direction of the heating roller 2 heated by the heating unit 8 may be minimized. For example, it is desirable that L1 should be equal or larger than at least the size of the shorter edge of A4 and that the heating region (L1+2·L2) should be equal to or larger than at least the size of the shorter edge of A3.

The controller board 11 is connected to the CPU 22 of a main control unit 21. The main control unit 21 includes the CPU 22, a driving circuit 13, an operation section 14, a RAM 15, a ROM 16, a counter 17, a timer 18, and the output sensor 9.

The driving circuit 13 is connected to a motor M that rotates the heating roller 2.

The counter 17 counts, for example, the sheets Q taken out of the cassette 108 as the number of sheets of copy paper to be copied X1 (the number of sheets passed) and outputs the counted number of copies X1 to the CPU 22 at any time. When the number of copies X1 from the counter 17 has reached the number of copies X2 specified from the operation section 14 (or the number of copies X2 on the basis of the number of sheets read by the scanner 102), the CPU 22 can determine that the last sheet has passed, on the basis of the signal from the output sensor 9.

The timer 18 can measure, for example, time Z1 elapsed since the sheet Q was taken out of the sheet cassette 108 by the pickup roller 109. In addition, the timer can measure predetermined elapsed time Z2 since the copy was stopped and predetermined elapsed time Z3 since the temperature drop control mode was ended.

On the basis of the time Z1 measured by the timer 18, the CPU 22 can calculate the position of the sheet Q transported at 133 mm/sec (process speed). For example, in the consecutive copying of size-A4 sheets with the 210-mm shorter edge as the transportation length, the timing with which the leading edge of the last sheet is transported to the inlet of the fuser 1 is about 1.58 seconds before the passing of the trailing edge of the last sheet is completed. Therefore, "just before the last sheet is led to the inlet of the fuser" means at least two seconds before the passing of the trailing edge of the last sheet is completed. Alternatively, it may mean after the elapse of the time from when the last sheet is taken out by the pickup roller 109 until the last sheet is led to the inlet of the fuser 1.

The RAM 15 can hold the number of copies X1, the number of copies X2, the time Z1 measured by the timer 18, and others temporarily.

The ROM 16 can hold the optimum fixing temperature T3, a first temperature T4, a second temperature T5, a first number of copies Y2, a second number of copies Y3, and others.

Next, using FIGS. 4 to 8, (1) the temperature drop control mode, (2) the lamp OFF control mode, and (3) the temperature recovery mode will be explained.

Figure 4:
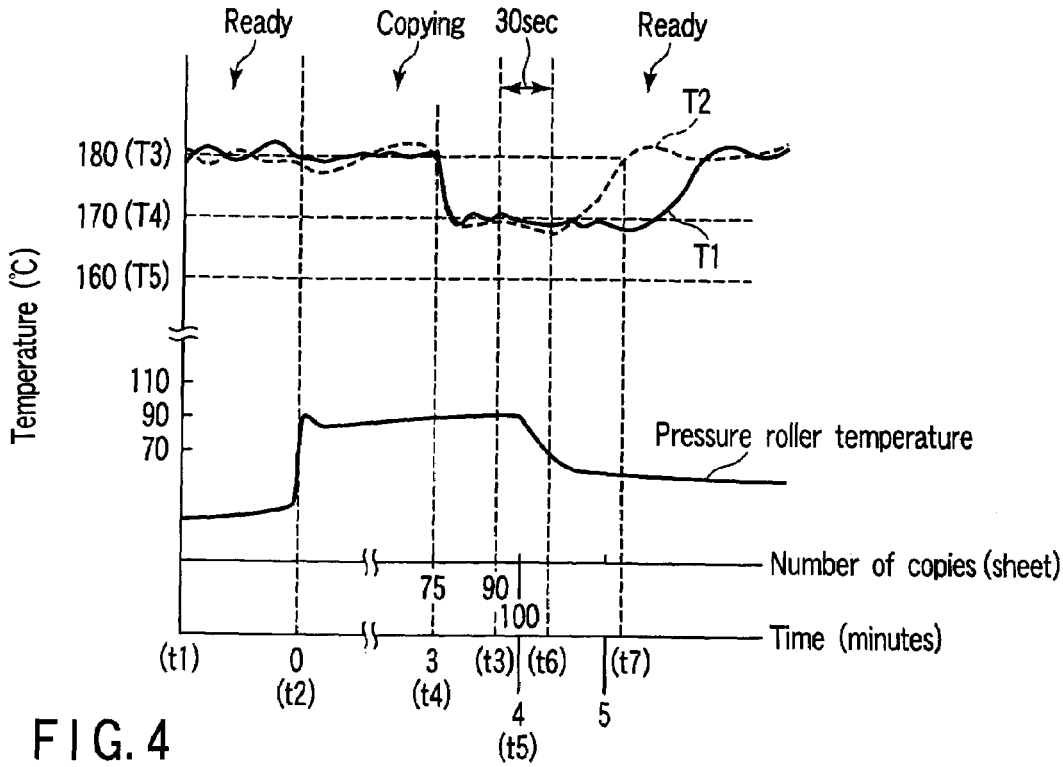
FIG. 4 is a reference diagram to help explain a heating method to which the embodiment of the invention can be applied.
Figure 5:
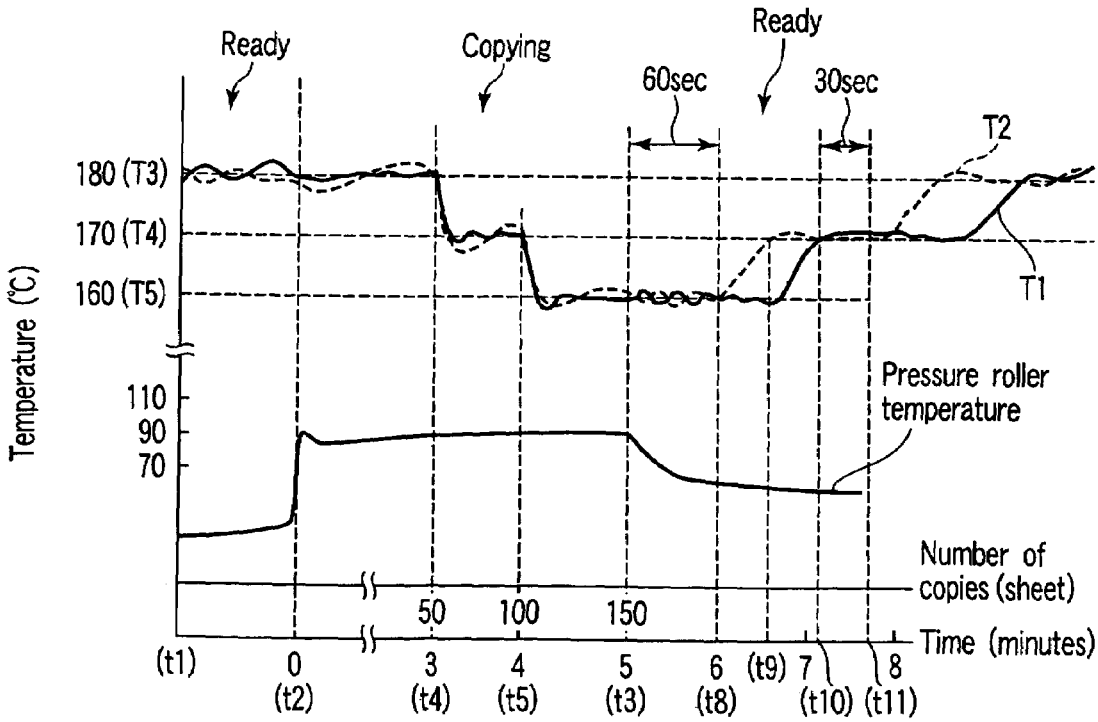
FIG. 5 is a reference diagram to help explain another heating method to which the embodiment of the invention can be applied.
Figure 11:
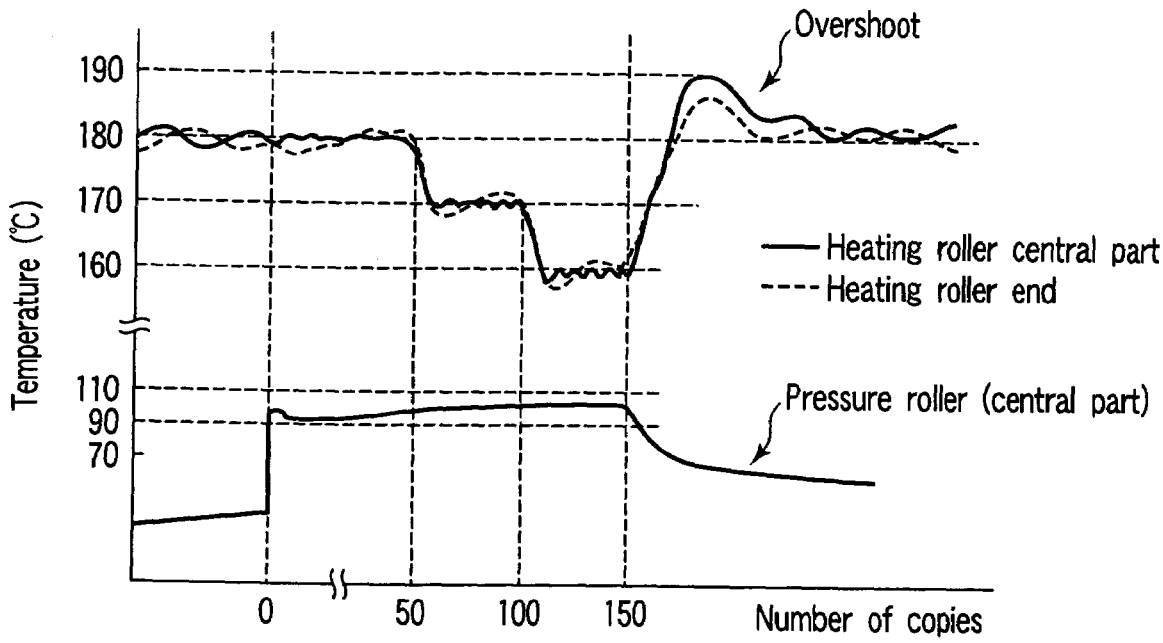
FIG. 11 PRIOR ART
FIG. 11 is a reference diagram to help explain a conventional example to describe the effect of the embodiment of the invention.

FIG. 4 shows the number of copies and time (abscissa axis) and the sensed temperature (ordinate axis) when a recovery is made from a first drop control. In addition, FIG. 5 shows the number of copies and time (abscissa axis) and the sensed temperature (ordinate axis) when a recovery is made from a second drop control. Furthermore, FIG. 11 shows a conventional example to help explain the effect of the embodiment of the present invention.

As shown in FIG. 5, in the ready state until a copy is started, the center temperature T1 and end temperature T2 of the heating roller 2 are maintained at the optimum fixing temperature T3 (T3=180° C.) and controlled so that the difference between the temperatures T1 and T2 may be minimized (hereinafter, this control is referred to as normal control) (t1-t2).

Here, "Copy" is turned ON, the temperature T1 in the central part of the heating roller 2 which the sheet Q passes more frequently is kept almost constantly at the optimum fixing temperature T3, but the end temperature T2 rises gradually and becomes higher than the central part temperature T1 in the end (e.g., t2-t4).

(1) The temperature drop control mode is control to drop the surface temperatures of both rollers stepwise on the basis of the number of copies, the sheet passing time, the sensed temperature, and others, when the heating roller 2 and pressure roller 3 are warmed as a result of consecutive copying. The temperature T1 in the central part of the heating roller 2 and the temperature T2 at the end are maintained at the first temperature T4 (T4=170° C.), when the number of copies X2 has reached the first number of copies Y2 (Y2=50 copies) (first drop control). They are maintained at the second temperature T5 (T5=160° C.), when the number of copies X2 has reached the second number of copies Y3 (Y3=100 copies) (second drip control).

In a case where the first drop control is performed, following on the normal control whereby the heating roller is kept at the optimum fixing temperature T3, and more than the first number of copies, or 50 copies, are made consecutively, the heating roller 2 is kept uniformly in the axial direction at the first temperature T4 lower than the optimum fixing temperature T3 by a predetermined value in order to prevent the surface temperature of the heating roller 2 from rising too much (t4-t5).

Furthermore, in a case where the second drop control is performed, following on the first drop control, and more than the second number of copies, or 100 copies, are made consecutively, the heating roller 2 can maintain uniformly in the axial direction the second temperature T5 lower than the first temperature T4 by a predetermined value (t5-t3).

Figure 6:
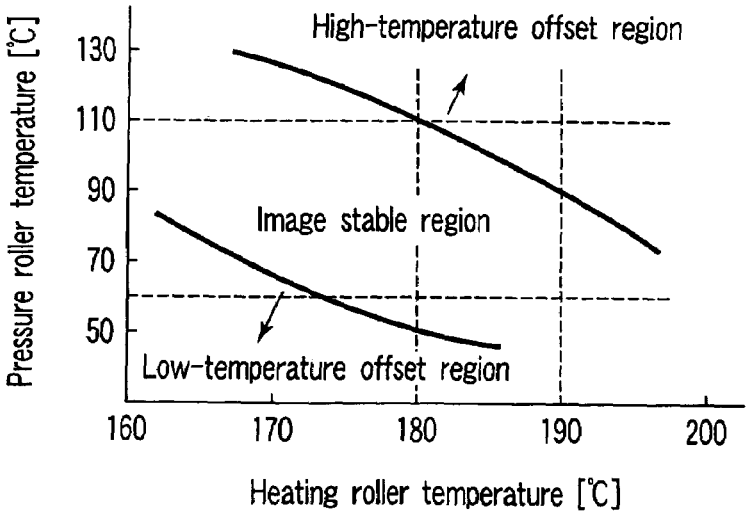
FIG. 6 is a reference diagram to help explain FIGS. 4 and 5.

In the embodiment, the optimum fixing temperature T3 is 180° C., the first temperature T4 is 170° C., the second temperature T5 is 160° C., the first number of copies Y2 is 50, and the second number of copies Y3 is 100. As shown in FIG. 6, this applies to the image stable region in the relationship between the temperature of the heating roller 2 and that of the pressure roller 3 in the embodiment.

Here, since the consecutive copying is completed and the ready state is on again (t3-), the surface temperature of the heating roller 2 is returned to the optimum fixing temperature T3. As shown in FIG. 11, however, it is recognized that overshoot occurs in the prior art. As shown in FIG. 6, this applies to the high-temperature offset region in the relationship between the temperature of the heating roller 2 and that of the pressure roller 3 in the embodiment.

(2) Lamp OFF control turns off the heater lamps 81, 82 with predetermined timing according to the type of temperature drop control mode in the preceding stage, thereby preventing the occurrence of overshoot efficiently.

As shown in FIG. 7, since the number of copies X2 is 5 or less in type A, the temperature drop control mode is not applied.

In type B, the number of copies X2 is 6 or more and the temperature drop control mode is not executed. That is, since the number of copies X2 is 50 or less, consecutive copying is effected at the optimum fixing temperature T1. At this time, since the temperature T2 at the end of the heating roller 2 can rise (see t2-t4 in FIG. 5), the OFF timing of the central heater lamp 81 has priority over the OFF timing of the end heater lamp 82. Therefore, the central heater lamp 81, the priority lamp, is turned off 0 seconds (immediately) after the trailing edge of the last sheet has passed the outlet of the fuser 1. The end heater lamp 82, the posterior lamp, is turned off when the copying is stopped, or one second after the priority lamp is turned off. "When the copying is stopped" means when the driving circuit 13 is stopped, or when the main motor that rotates the photosensitive drum is stopped. This control is hereinafter referred to as the first lamp OFF control.

In type C (when the first drop control is performed), the OFF timing of the end heater lamp 82 has priority over the OFF timing of the central heater lamp 81. The end heater lamp 82, the priority lamp, is turned off during the time required for the last sheet to pass between the heating roller 2 and the pressure roller 3. That is, in the embodiment where the last sheet is A4, the end heater lamp 82 is turned off two seconds before the trailing edge of the last sheet passes the outlet of the fuser 1. The central heater lamp 81, the posterior lamp, is turned off 0 seconds (immediately) after the trailing edge of the last sheet has passed the outlet of the fuser 1. This control is hereinafter referred to as the second lamp OFF control.

In type D, since the second drop control is performed, the temperature drop control mode is not applied.

The lamp OFF control mode is completed two seconds after the copying is stopped. Then, the mode is changed to (3) the temperature recovery control mode explained below.

In the embodiment, the explanation has been given on the assumption that the copy sheet is of size A4. When sheets of a different size are fed, the time set in step S8 (see FIG. 9) may be before at least the leading edge of the last sheet comes into contact with both of the rollers 2, 3 of the fuser, instead of 2 seconds.

FIG. 8 is a reference diagram to help explain (3) the temperature recovery control mode.

As shown in FIG. 8, in type A, since the number of copies X2 is 5 or less, the control is changed to the normal control 0 seconds (immediately) after the lamp OFF control mode is completed, that is, two seconds after the copying is stopped. The surface temperature of the heating roller 2 is then returned to the optimum fixing temperature T3 in the original ready state.

Type B applies to a case where the number of copies X2 is 6 or more, but the first drop control is not executed, that is, a case where 6≦the number of copies X2<50 in the embodiment. In this case, two seconds after the lamp OFF control mode is completed, that is, four seconds after the copying is stopped, the control is changed to the normal control, with the result that the surface temperature of the heating roller 2 is returned to the optimum fixing temperature T3 in the ready state.

Type C applies to a case where the first drop control has been performed immediately before, or a case where 75≦the number of copies X2<100 in the embodiment. In this case, as shown in FIG. 4, after a lapse of 30 seconds (t6) from the copying is stopped (t3), control is so performed that both of the temperatures T1 and T2 are kept at the first temperature T4 (170° C.). Thereafter, only the priority lamp is brought into the normal control. That is, after a lapse of 30 seconds (t6) from the copying is stopped, when the electric power supplied to the end heater lamp 82 is increased and the end temperature T2 is returned to the optimum fixing temperature T3 (t7), the control is brought into the normal control. That is, the designation of the priority lamp is cancelled. When the end temperature T2 is recovered, the electric power supplied to the central heater lamp 81 is increased. After the center temperature T1 is returned to the optimum fixing temperature T3, the control is brought into the normal control. This control is hereinafter referred to as the first recovery control.

Type D applies to a case where the second drop control has been performed immediately before, or a case where 100≦the number of copies X2 in the embodiment. In this case, as shown in FIG. 5, after a lapse of 60 seconds (t8) from the copying is stopped (t3), control is so performed that both of the temperatures T1 and T2 are kept at the second temperature T5 (160° C.). Thereafter, only the priority lamp is brought into the first recovery control. That is, after a lapse of 60 seconds (t8) from the copying is stopped, when the electric power supplied to the end heater lamp 82 is increased and the end temperature T2 is returned to the first temperature T4 (t9), control is performed so as to keep the end temperature T2 at the first temperature T4. That is, the designation of the priority lamp is cancelled. When the end temperature T2 is recovered, the electric power supplied to the central heater lamp 81 is increased, thereby returning the center temperature T1 to the first temperature T4. After both of the rollers 2 and 3 are returned to the first temperature T4, the control is changed to the first recovery control. That is, after a lapse of 30 seconds (t11) from the center temperature T1 has reached the first temperature T4 (t10), only the priority lamp is brought into the normal control. When the end temperature T2 has reached the optimum fixing temperature T3, the center temperature T1 is returned to the optimum fixing temperature T3. This control is hereinafter referred to as the second recovery control.

When "Copy ON" is specified in the middle of executing (2) the lamp OFF control mode or (3) the temperature recovery control mode, both of the modes (2) and (3) in operation are ended and the control is changed to the copy control.

While in the embodiment, the OFF timing is selected according to the temperature drop control mode, the present invention is not limited to this. For instance, the OFF timing may be selected according to the surface temperatures T1, T2 of the heating roller 2 sensed by thermistors 5, 6.

Furthermore, while in the embodiment, the first drop control has been executed on the basis of the number of copies, the present invention is not limited to this. For instance, the first drop control may be performed on the basis of the elapsed time since the start of copying. Specifically, the first drop control may be performed three minutes after the start of copying and the second drop control may be performed four minutes after the start of copying.

Figure 9:
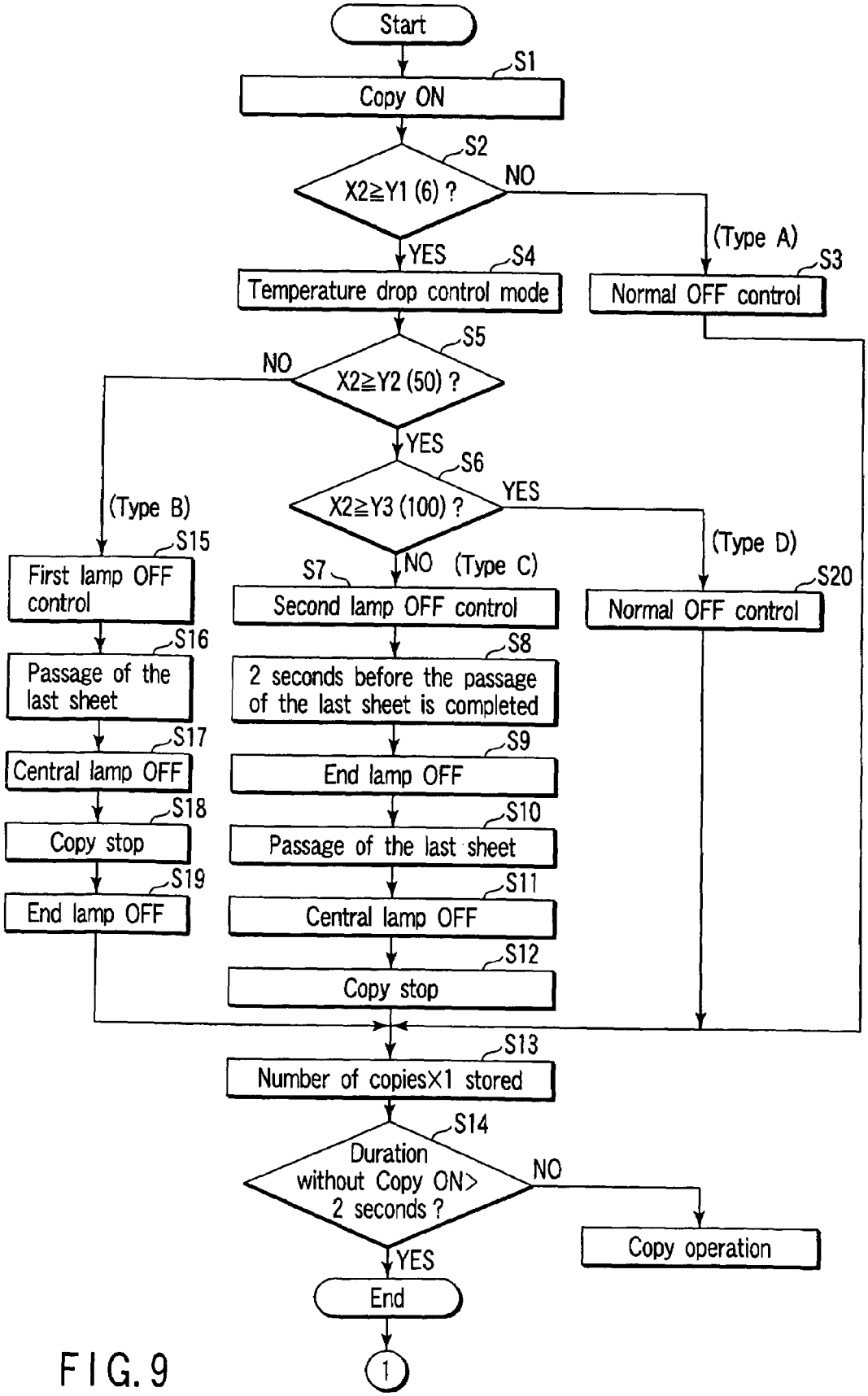
FIG. 9 is a flowchart to help explain a heating method to which the embodiment of the invention can be applied.

FIG. 9 is a flowchart to help explain an example of (2) the lamp OFF control mode.

As shown in FIG. 9, the copy start is specified (S1), the number of copies X2 is compared with a consecutive copy preset value Y1 (Y1=6) (S2), thereby determining whether consecutive copying is to be done. If the number of copies X2 is 6 or more, it is determined that consecutive copying is to be done (S2—YES) and the mode is changed to the temperature drop control mode (S4). If the number of copies X2 is less than Y1, it is determined that normal copying is to be done (type A in FIG. 7) (S2—NO) and the normal OFF control is performed (S3).

The number of copies X2 is compared with the first number of copies Y2 (Y2=50) (S5), thereby determining whether the temperature drop control mode has been used. If the number of copies X2 is 50 or more (S5—YES), it is determined that the temperature drop control mode has been used. Then, the number of copies X2 is compared with the second number of copies Y3 (Y3=100) (S6), thereby determining whether the second drop control has been performed. If the number of copies X2 is less than 100 (S6—NO), the first drop control in the temperature drop control mode is performed, a decision is made on type C shown in FIG. 7, and the control is changed to the second lamp OFF control (S7).

When the time has reached two seconds before the trailing edge of the last sheet passes the fuser 1 (S8), the CPU 22 (controller board 11) turns off the end heater lamp 82 (S9).

Thereafter, when the training edge of the last sheet has passed the fuser 1, that is, when two seconds have passed since step S8 (S10), the central part heater lamp 81 is turned off (S11).

After the copying operation is completed (S12), the driving circuit 13 is stopped, the rotation of the heating roller 2 and pressure roller 3 is stopped, and the number of copies X1 is stored (S13).

Then, "Copy ON" is not specified for at least two consecutive seconds (S14—YES), the temperature drop control mode is ended.

In step S5, if the number of copies X2 is less than 50 (S5—NO), it is determined that the temperature drop control mode has not been used and the control is changed to the first lamp OFF control in type B shown in FIG. 7 (S15).

Immediately after the trailing edge of the last sheet has passed the fuser 1, the CPU 22 (controller board 11) turns off the central heater lamp 81 (S17). Thereafter, when the copying has been stopped (S18), the end heater lamp 82 is turned off (S19) and the number of copies X1 is stored (S13).

In step S6, if the number of copies X2 is equal to or more than 100 (S6—YES), it is determined that the second drop control in the temperature drop control mode has been performed (type D shown in FIG. 7) and the control is changed to the normal OFF control (S20).

Figure 10:
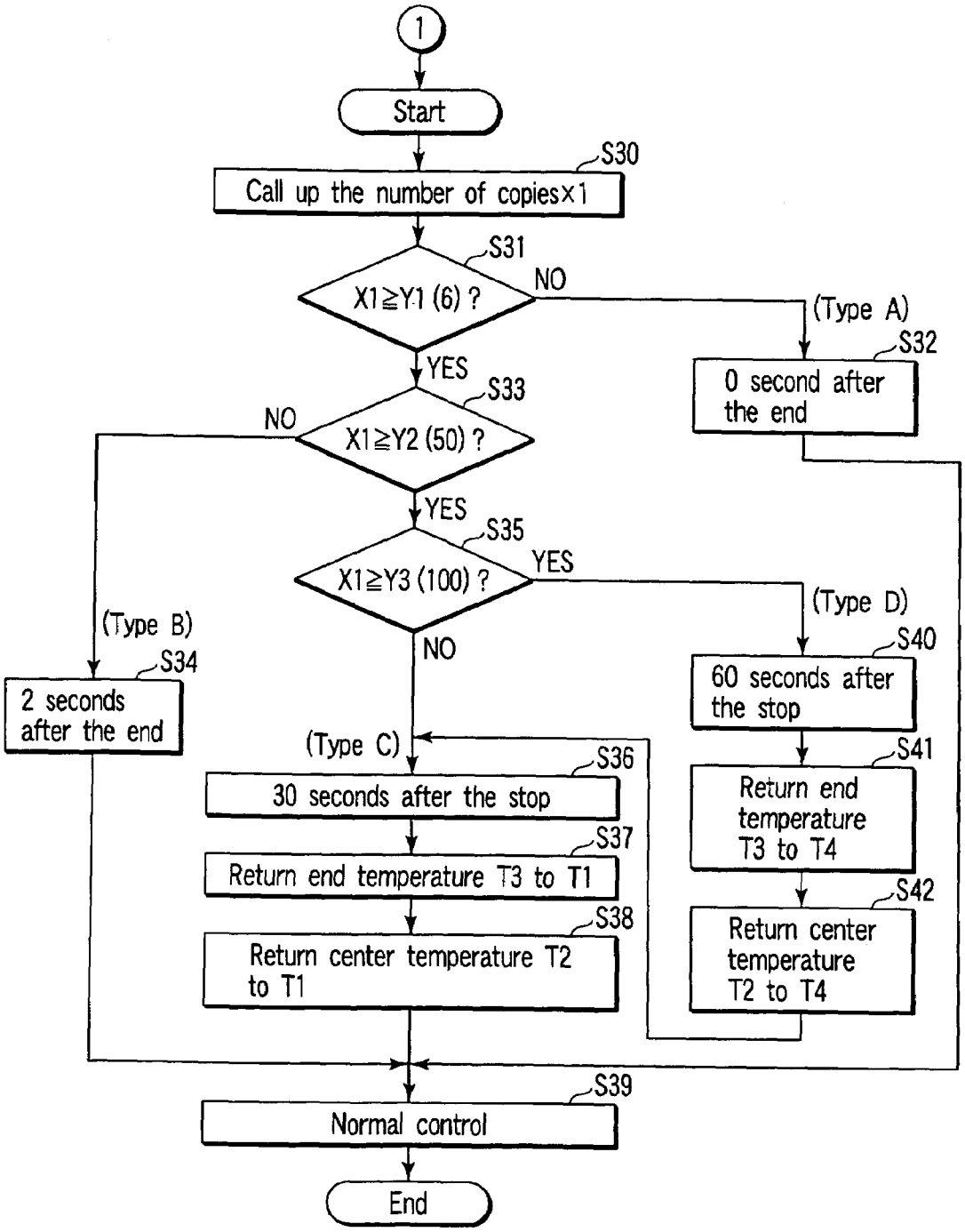
FIG. 10 is a flowchart to help explain another heating method to which the embodiment of the invention can be applied.

FIG. 10 is a flowchart to help explain an example of (3) the temperature recovery control mode.

As explained in FIG. 9, after the copying is ended, if "Copy ON" is not specified for two or more seconds, (2) the lamp OFF control mode is ended and the mode is changed to (3) the temperature recovery control mode.

As shown in FIG. 10, the number of copies X1 stored in the preceding copy operation is called up (S30) and a decision is made on the type of the previously used temperature drop control mode.

The number of copies X1 is compared with the consecutive copying preset value Y1 (Y1=6) (S31). If the number of copies X1 is less than 6, a decision is made on type A (S31—NO). Therefore, 0 seconds after the temperature drop control mode is ended (S32), the control is changed to the normal control (S39).

If the number of copies X1 is 6 or more (S31—YES), the number of copies X1 is further compared with the first number of copies Y2 (Y2=50) (S33), thereby determining whether the temperature drop control mode has been used. If the number of copies X1 is less than 50, a decision is made on type B (S33—NO). Two seconds have elapsed after the temperature drop control mode is completed (S34), the control is changed to the normal control (S39).

If the number of copies X1 is 50 or more (S33—YES), the number of copies X1 is further compared with the second number of copies Y3 (Y3=100) (S35), thereby determining whether the second drop control has been performed. If the number of copies X1 is smaller than 100, a decision is made on type C (S35—NO). Therefore, 30 seconds have elapsed after the copying is stopped (S36), the end temperature T2 in the surface temperature of the heating roller 2 is returned to the optimum fixing temperature T3 (S37). When the end temperature T2 is recovered, the center temperature T1 is returned to the optimum fixing temperature T3 (S38) and the control is changed to the normal control to maintain the ready state (S39).

In step S35, if the number of copies X1 is 100 or more, a decision is made on type D (S35—YES). Therefore, 60 seconds have elapsed after the copying is stopped (S40), the end temperature T2 in the surface temperature of the heating roller 2 is returned to the first temperature T4 (S41). When the end temperature T2 is recovered, the center temperature T1 is returned to the first temperature T4 (S42) and the control is changed to the first recovery control in type C.

After both of the temperatures T1 and T2 are returned to the first temperature T4, they are kept at the first temperature T4 for 30 seconds (S36). After 30 seconds have elapsed, the end temperature T2 is returned to the optimum fixing temperature T3 (S37). When the end temperature T2 has been recovered, the center temperature T1 is returned to the optimum fixing temperature T3 (S38) and the control is changed to the normal control to maintain the ready state.

As described above, in addition to the first drop control, the second drop control is performed to drop the temperature to the still lower second temperature T5, which prevents the occurrence of overshoot more.

What is claimed is:

1. An image forming apparatus comprising:

a heating member which includes a first region and a second region:

the second region locates in a predetermined position in the axial direction with respect to the first region;

a heating unit which is provided inside the heating member and which includes at least one of a first heating member for heating the first region and a second heating member for heating the second region;

a main control unit which carries out at least a first control mode and a second control mode;

wherein the first control mode performs control to drop the temperatures in the first and second regions from a fixing temperature by a predetermined temperature, with specific timing corresponding to a number of mediums on which an image is to be formed, at least once, while an image formation is being executed at the fixing temperature; and wherein the second control mode turns off either the first heating member or the second heating member which has priority over the other member, the priority being determined according to the number of mediums on which an image is to be formed, with predetermined timing corresponding to the temperature supplied in the first control mode, when the image formation is completed.

2. The image forming apparatus according to claim 1, wherein the first region is disposed at the center of the heating member, and the second region is disposed at both ends of the first region, and when control to drop the temperatures has been performed once by the first control mode, the second heating member has priority over the first heating member in being turned off first.

3. The image forming apparatus according to claim 2, further comprising:

a third control mode which is carried out by the main control unit and which returns the temperatures in the first and second regions to the fixing temperature stepwise when the temperatures in the first and second regions have been lowered from the fixing temperature in the first control mode after the main control unit image formation is completed, wherein the temperature of the second heating member to which priority has been given by the first control mode is returned first.

4. The image forming apparatus according to claim 2, wherein the first region is disposed at the center of the heating member, and the second region is disposed at both ends of the first region, wherein when control to drop the temperatures by the first control mode is not performed, the first heating member has priority over the second heating member in being turned off.

5. The image forming apparatus according to claim 1, further comprising:

a third control mode which is carried out by the main control unit and which returns the temperatures in the first and second regions to the fixing temperature stepwise when the temperatures in the first and second regions have been lowered from the fixing temperature in the first control mode after the main control unit image formation is completed, wherein the temperature of the first heating member or the second heating member to which priority has been given by the first control mode is returned first.

6. A method of controlling a heating unit, comprising:

(1) when an image formation is executed at a first temperature, performing control to drop the temperature of a heating member to a second temperature lower than the first temperature, with predetermined timing corresponding to a number of mediums on which an image is to be formed, at least once;

(2) when the image formation is completed, turning off the heating member with predetermined timing corresponding to the second temperature lowered from the first temperature stepwise, when the heating member composed of a first heating member and a second heating member is turned off, either the first heating member or the second heating member which has priority over the other heating member is turned off first, the priority being determined according to the number of mediums on which an image is to be formed; and (3) after the image formation is completed, returning from the second temperature to the first temperature stepwise.

7. The method of controlling a heating unit according to claim 6, wherein the timing with which the first and second heating members are turned off is determined by the second temperature obtained in dropping from the first temperature.

8. The method of controlling a heating unit according to claim 6, wherein when the temperature of the heating member composed of a first heating member and a second heating member is recovered stepwise, shifting the timing with which the temperature in a first region heated by the first heating member rises from the timing with which the temperature in a second region heated by the second heating member rises.

9. The method of controlling a heating unit according to claim 8, wherein the timing with which the first and second regions are raised is determined by the second temperature obtained in dropping from the first temperature.

10. The method of controlling a heating unit according to claim 6, wherein when the first heating member heats the center of the heating member, and the second heating member heats both ends of the heating member, and the step of turning off the heating member is performed at once, the second heating member has priority over the first heating member in being turned off.

11. The method of controlling a heating unit according to claim 6, wherein the temperature of either the first heating member or the second heating member which has priority over the other heating member is returned first.

12. An image forming apparatus comprising:

a heating member includes a first heating member which heats a first region and a second heating member which heats a second region;

heating means for heating the heating member;

dropping means for dropping the heating member kept at a first temperature to a second temperature lower than the first temperature with predetermined timing corresponding to a number of mediums on which an image is to be formed;

OFF means for turning off, first, either the first heating member or the second heating member which has priority over the other heating member, the priority being determined according to the number of mediums on which an image is to be formed with predetermined timing according to the second temperature; and recovering means for returning the heating member kept at the second temperature to the first temperature with predetermined timing corresponding to the number of mediums on which an image is to be formed, wherein the temperature of either the first heating member or the second heating member which has the priority is returned first.

13. The image forming apparatus according to claim 12, wherein the OFF means shifts the timing with which the first heating member is turned off from the timing with which the second heating member is turned off, when the heating member composed of the first heating member and the second heating member is turned off.

14. The image formation apparatus according to claim 13, wherein the timing with which the first and second heating member are turned off is determined by the second temperature obtained when the dropping means drops the temperature from the first temperature.

15. The image formation apparatus according to claim 12, wherein the recovering means shifts the timing with which the temperature in the first region is raised from the timing with which the temperature in the second region is raised.

16. The image formation apparatus according to claim 15, wherein the timing with which the temperatures in the first and second regions are raised is determined by the second temperature obtained when the dropping means drops the temperature from the first temperature.

* * * * *